US012782034B2

(12) United States Patent
Lee et al.

(10) Patent No.: US 12,782,034 B2
(45) Date of Patent: Nov. 3, 2026

(54) REFRIGERATOR AND NOISE-REDUCING DEVICE MOUNTED THERETO

(71) Applicant: LG ELECTRONICS INC., Seoul (KR)

(72) Inventors: Jongchan Lee, Seoul (KR); Youngeun Cho, Seoul (KR); Sunghyun Ki, Seoul (KR); Geunbae Hwang, Seoul (KR); Hyungwoo Kim, Seoul (KR); Jonghun Ha, Seoul (KR)

(73) Assignee: LG Electronics Inc., Seoul (KR)

( * ) Notice: Subject to any disclaimer, the term of this patent is extended or adjusted under 35 U.S.C. 154(b) by 253 days.

(21) Appl. No.: 18/276,683

(22) PCT Filed: Jan. 10, 2022

(86) PCT No.: PCT/KR2022/000373
§ 371 (c)(1),
(2) Date: Aug. 10, 2023

(87) PCT Pub. No.: WO2022/173133
PCT Pub. Date: Aug. 18, 2022

(65) Prior Publication Data

US 2024/0118016 A1 Apr. 11, 2024

(30) Foreign Application Priority Data

Feb. 10, 2021 (KR) ..... 10-2021-0019060
Feb. 10, 2021 (KR) ..... 10-2021-0019061

(51) Int. Cl.
*F25D 23/00* (2006.01)

(52) U.S. Cl.
CPC ..... *F25D 23/006* (2013.01); *F25D 2201/30* (2013.01)

(58) Field of Classification Search
CPC ..... F25D 23/006; F25D 2201/30
(Continued)

(56) References Cited

U.S. PATENT DOCUMENTS 1,783,276 A * 12/1930 Bliss ..... E06B 7/10 55/444
3,887,031 A * 6/1975 Wirt ..... G10K 11/172 181/292

(Continued)

FOREIGN PATENT DOCUMENTS

EP 0603752 B1 2/1998
JP 10-306972 * 11/1998

OTHER PUBLICATIONS

Translation of JP 10-306972 from J-Plat Pat (Year: 1998).*
Extended European Search Report in European Appln. No. 22752893.2, mailed on Apr. 7, 2025, 10 pages.

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator and a noise-reducing device mounted thereto are disclosed. The disclosed noise-reducing device, which comprises a hollow resonance chamber and a tubular acoustic filter inserted into the resonance chamber, is mounted at the side surface of a machine compartment, whereby not only heat due to the operation of a compressor is charged out of the machine compartment, but also noise transmitted from the compressor to the outside of the machine compartment is reduced through diffraction and resonance effects.

18 Claims, 20 Drawing Sheets

(58) Field of Classification Search
USPC ..... 312/406
See application file for complete search history.

(56) References Cited

U.S. PATENT DOCUMENTS

| | | | | |
|---|---|---|---|---|
| 4,989,252 | A * | 1/1991 | Nakanishi | G10K 11/17861 381/71.3 |
| 5,760,349 | A * | 6/1998 | Borchers | B64G 1/002 181/293 |
| 8,485,310 | B2 * | 7/2013 | Tanabe | G10K 11/172 454/262 |
| 8,689,936 | B2 * | 4/2014 | Richter | G10K 11/172 52/145 |
| 8,893,851 | B2 * | 11/2014 | Kitamura | G10K 11/161 181/210 |
| 11,378,325 | B2 * | 7/2022 | Berkhout | F25B 13/00 |
| 11,835,289 | B2 * | 12/2023 | Wang | F25D 11/02 |
| 12,111,093 | B2 * | 10/2024 | Zhu | F25D 23/003 |
| 2014/0014436 | A1 * | 1/2014 | Nguyen | F24F 13/082 181/210 |
| 2020/0348071 | A1 * | 11/2020 | Yang | F25D 23/10 |
| 2022/0146180 | A1 * | 5/2022 | Miao | F25D 17/062 |
| 2024/0060513 | A1 * | 2/2024 | Wan | F04D 29/665 |
| 2024/0210099 | A1 * | 6/2024 | Wan | F04B 39/123 |
| 2025/0014557 | A1 * | 1/2025 | Wan | G10K 11/175 |

* cited by examiner

【FIG. 1】
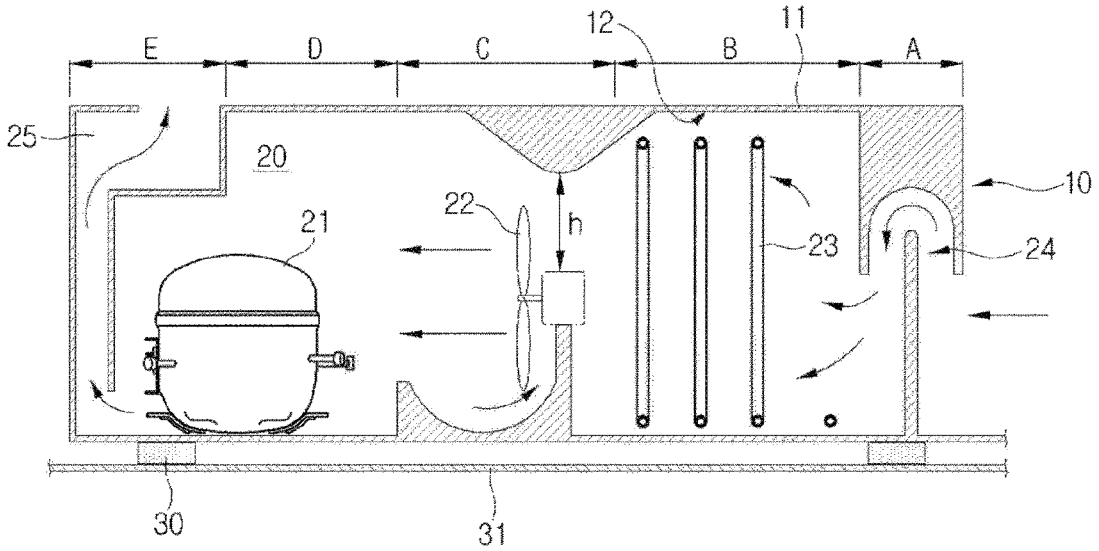

[FIG. 2]
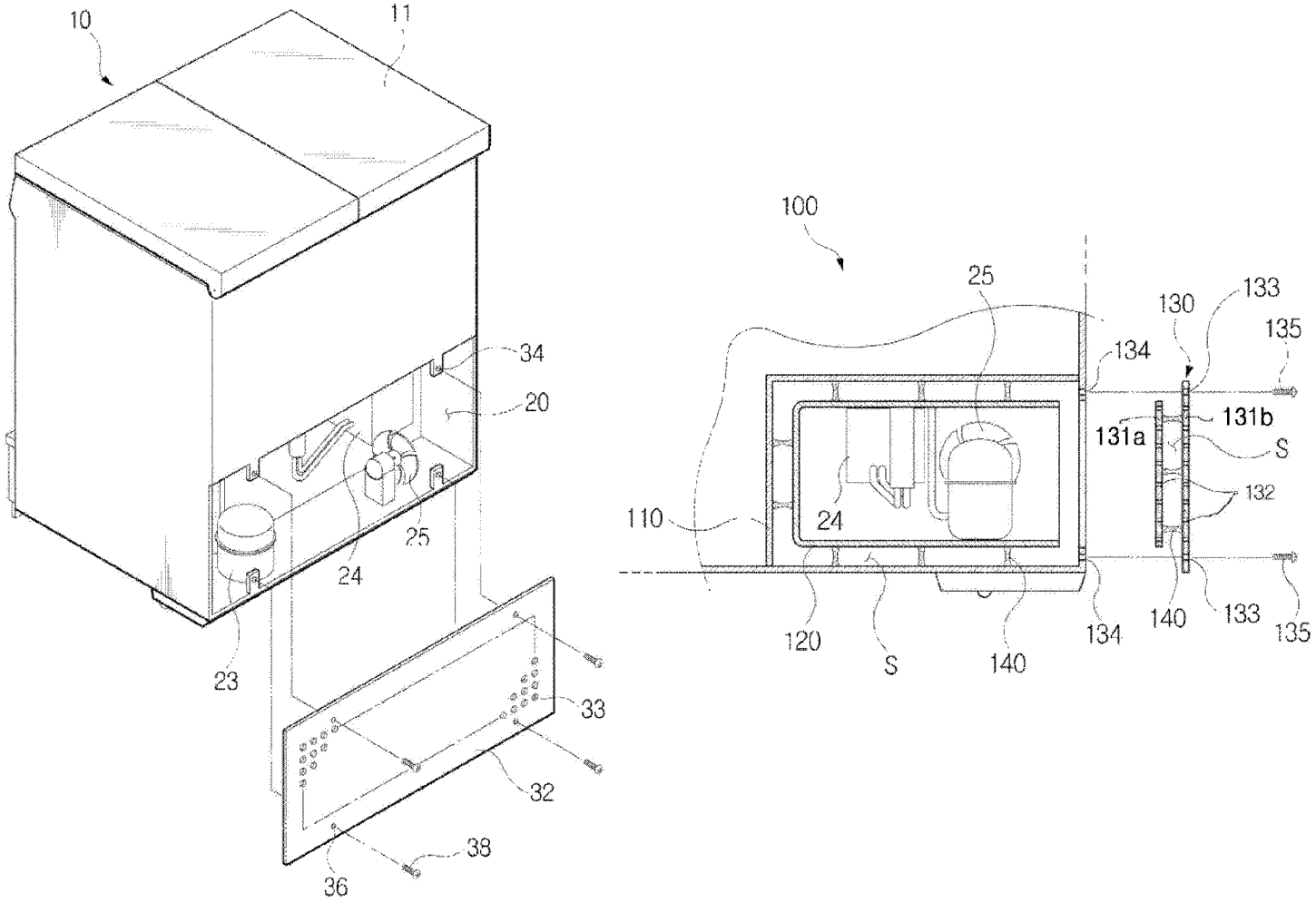

【FIG. 3】
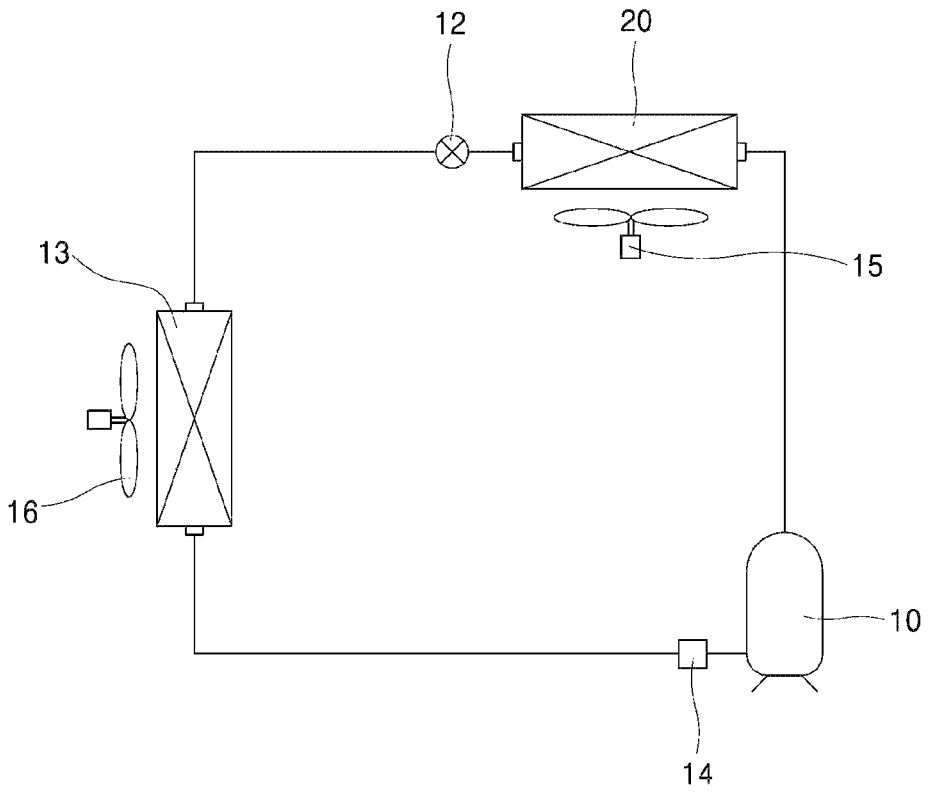

【FIG. 4】
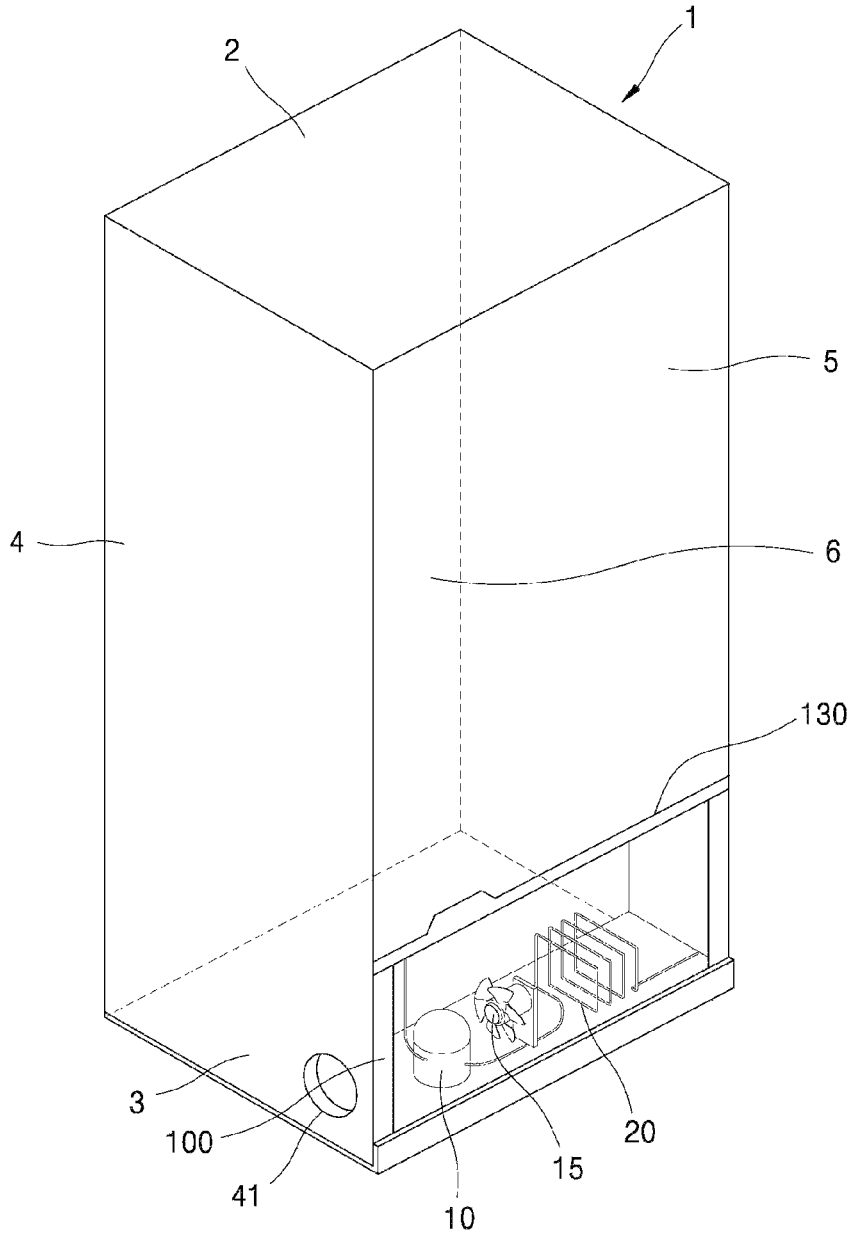

【FIG. 5A】
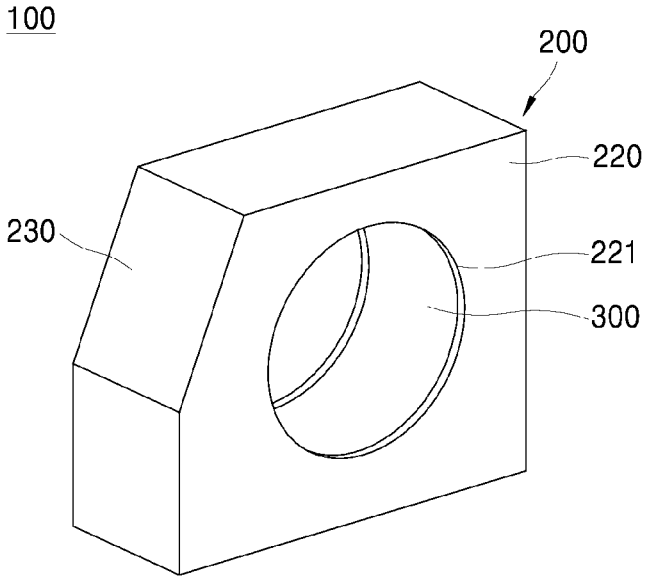
【FIG. 5B】
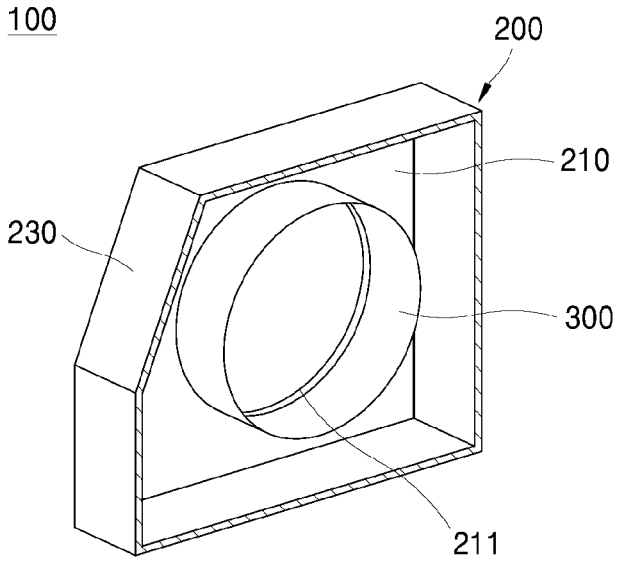

【FIG. 6A】
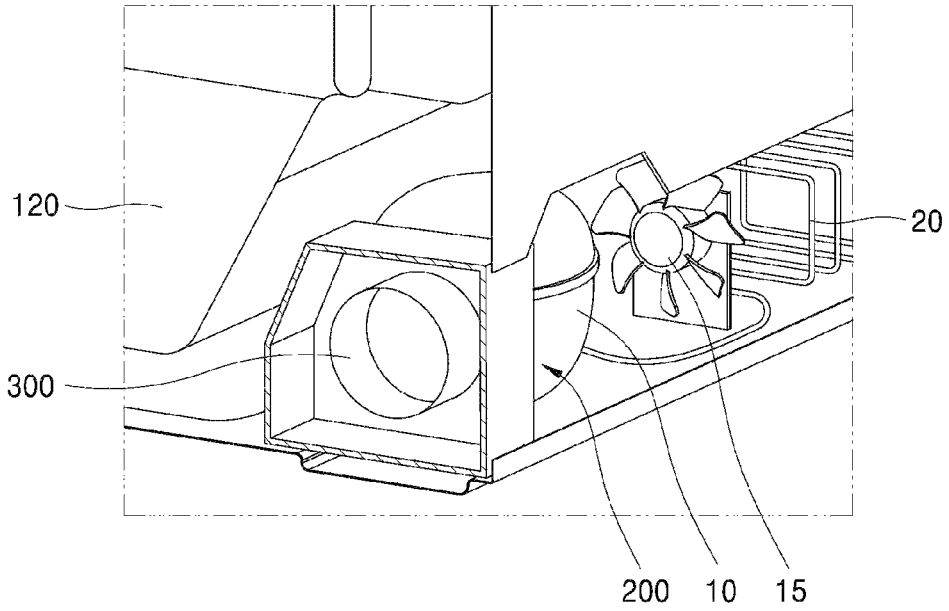
【FIG. 6B】
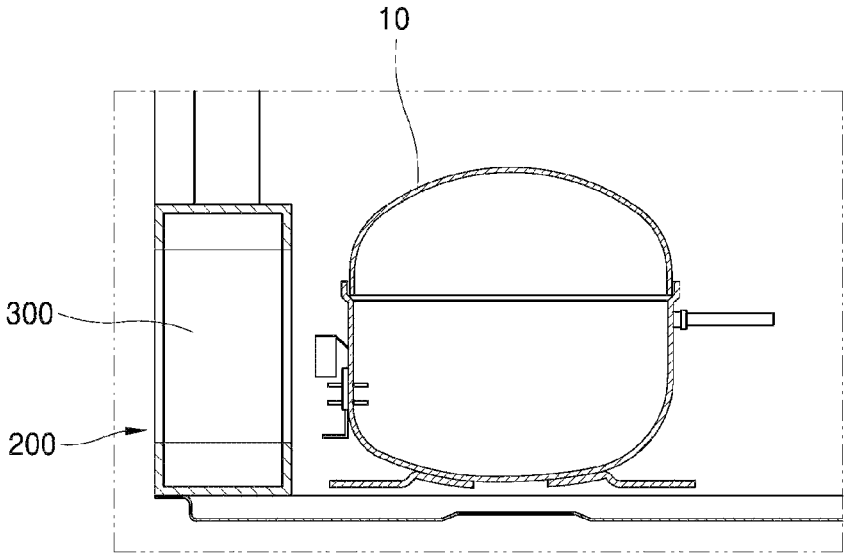

【FIG. 7A】
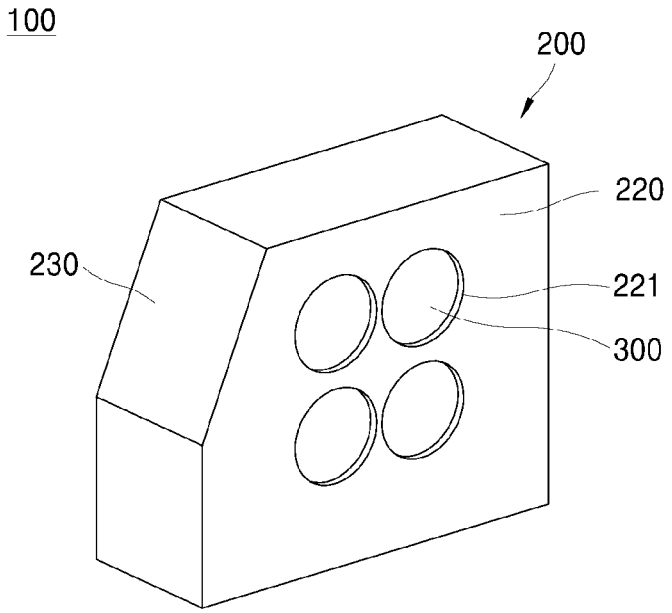
【FIG. 7B】
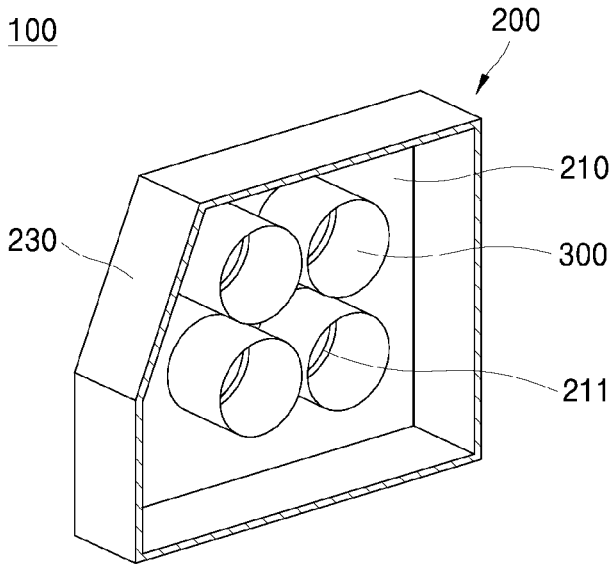

【FIG. 8A】
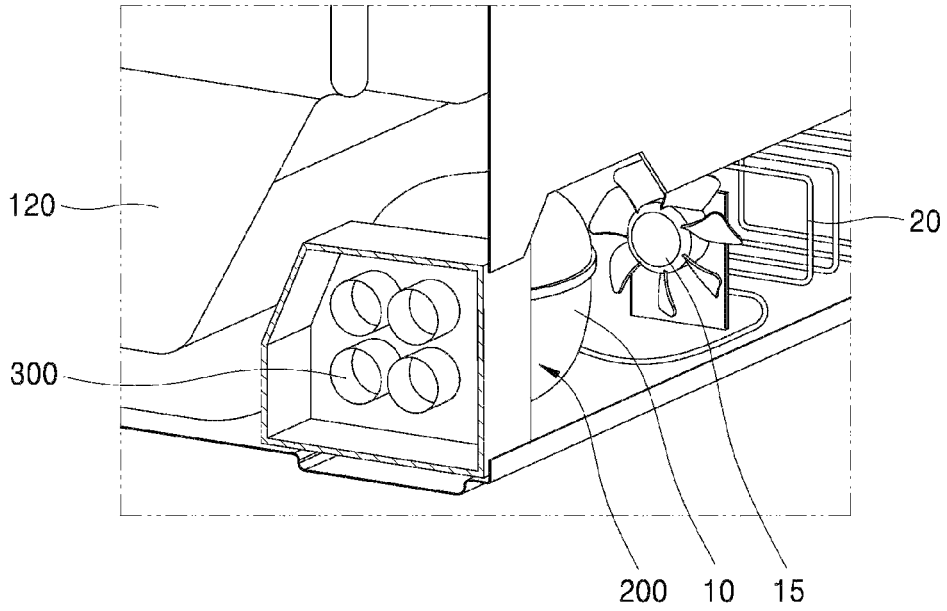
【FIG. 8B】
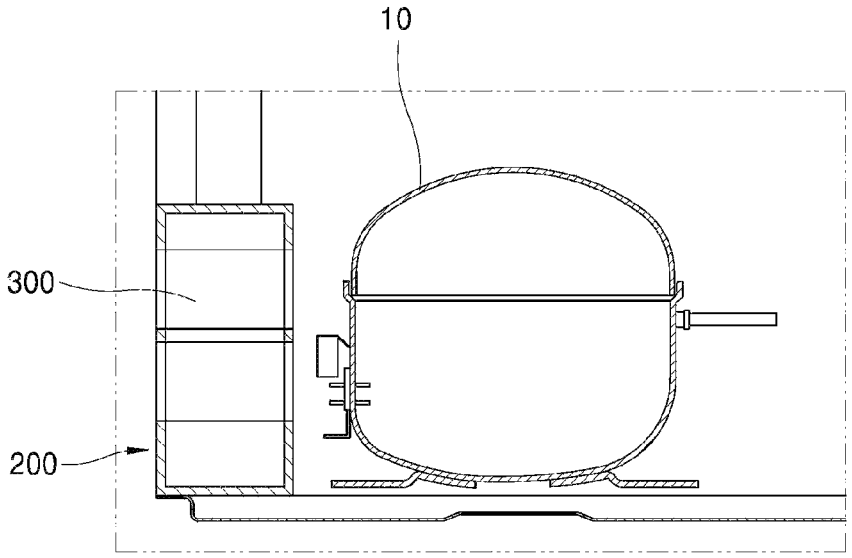

【FIG. 9A】
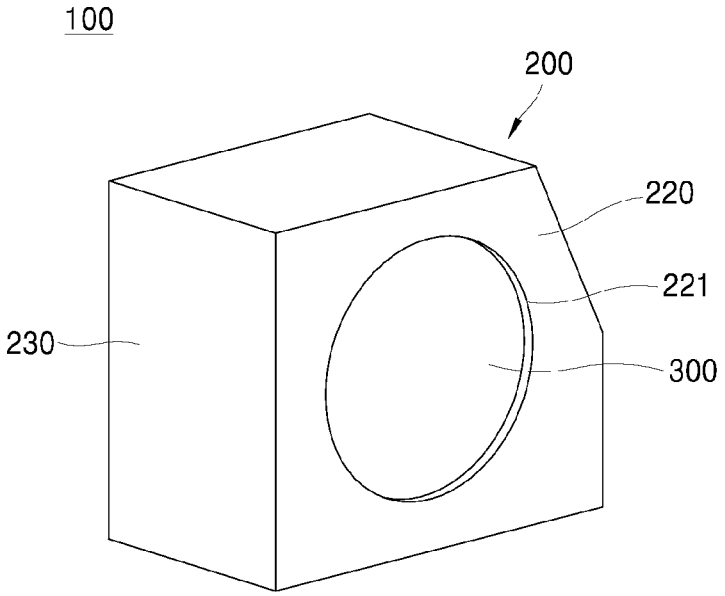
【FIG. 9B】
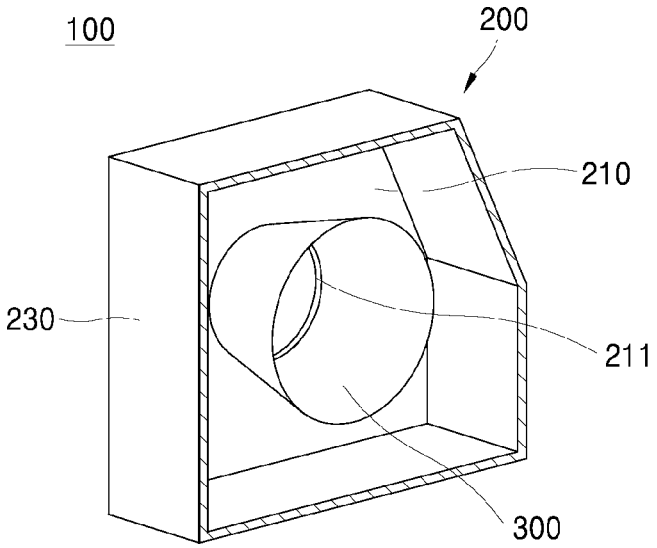

【FIG. 10A】
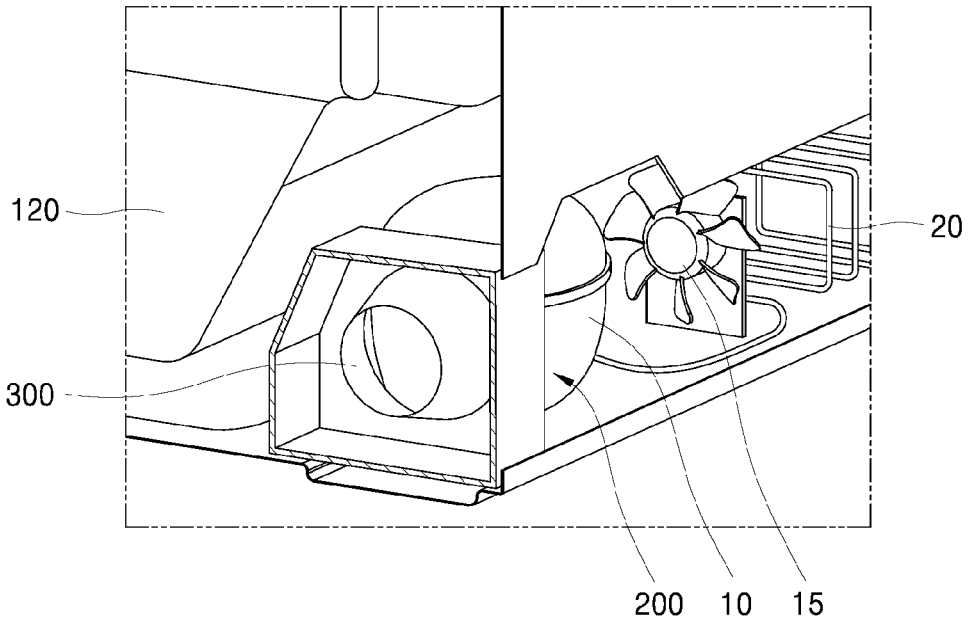
【FIG. 10B】
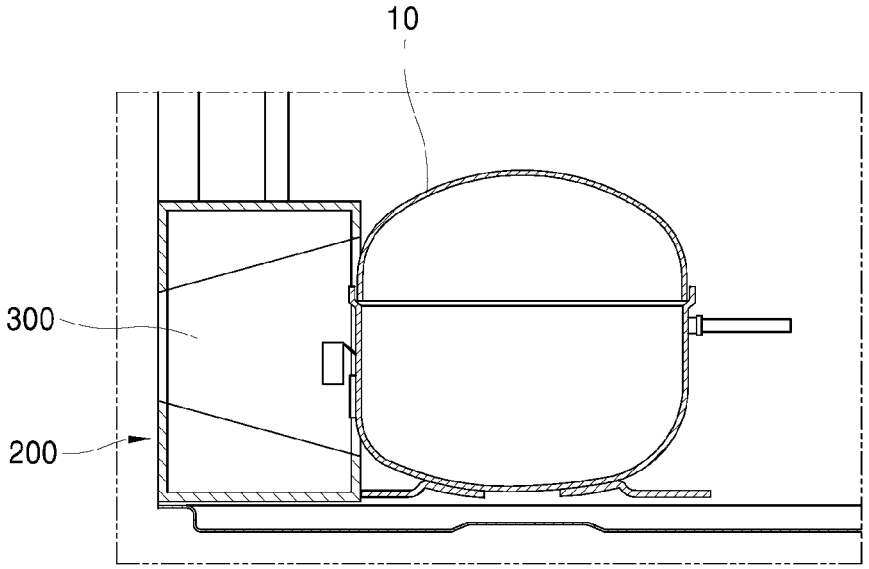

【FIG. 11A】
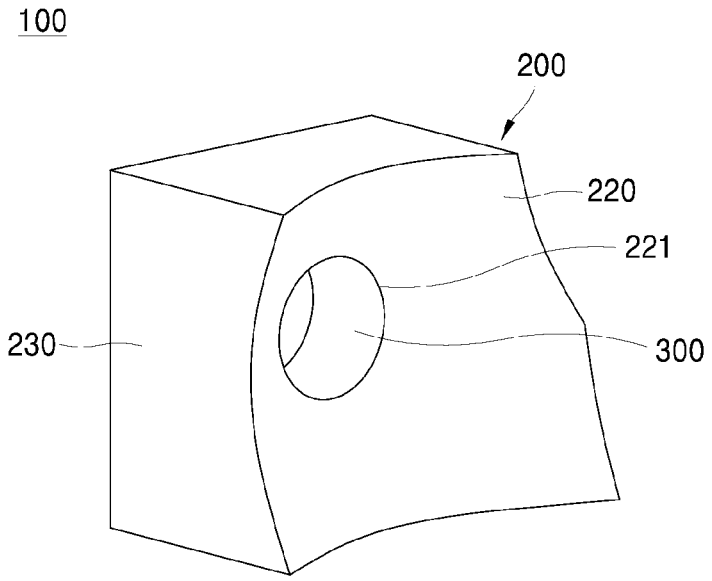
【FIG. 11B】
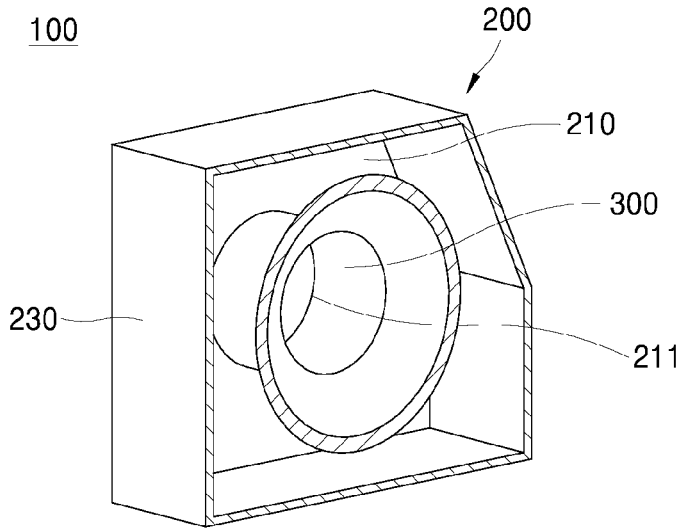

【FIG. 12A】
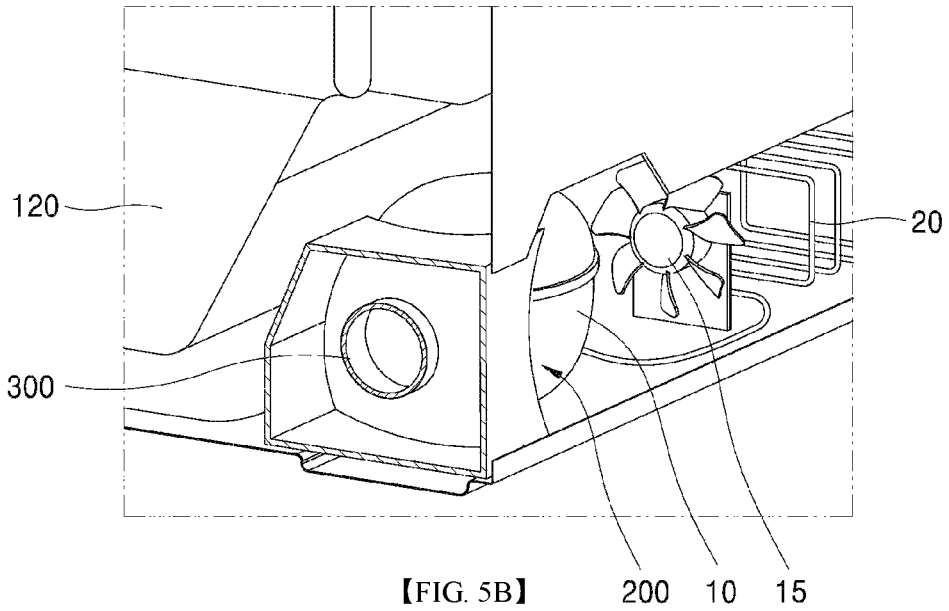
【FIG. 5B】
【FIG. 12B】
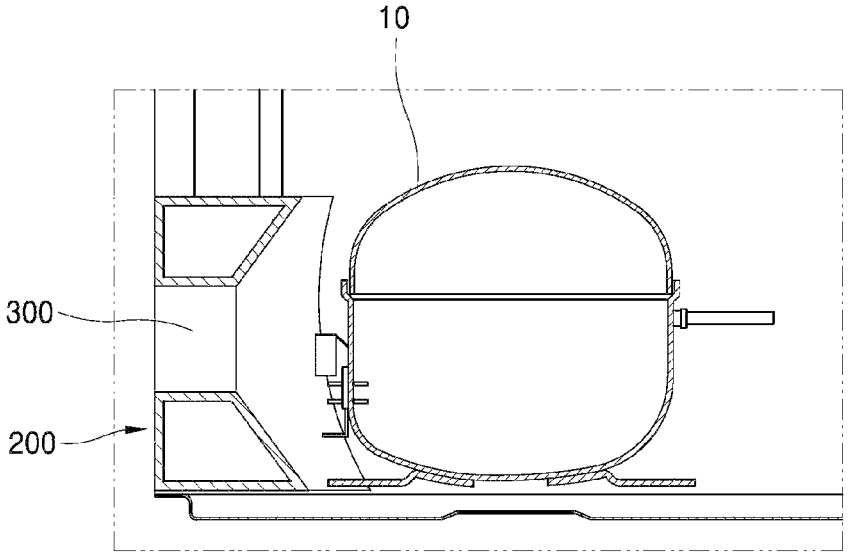
【FIG. 5B】

【FIG. 13】
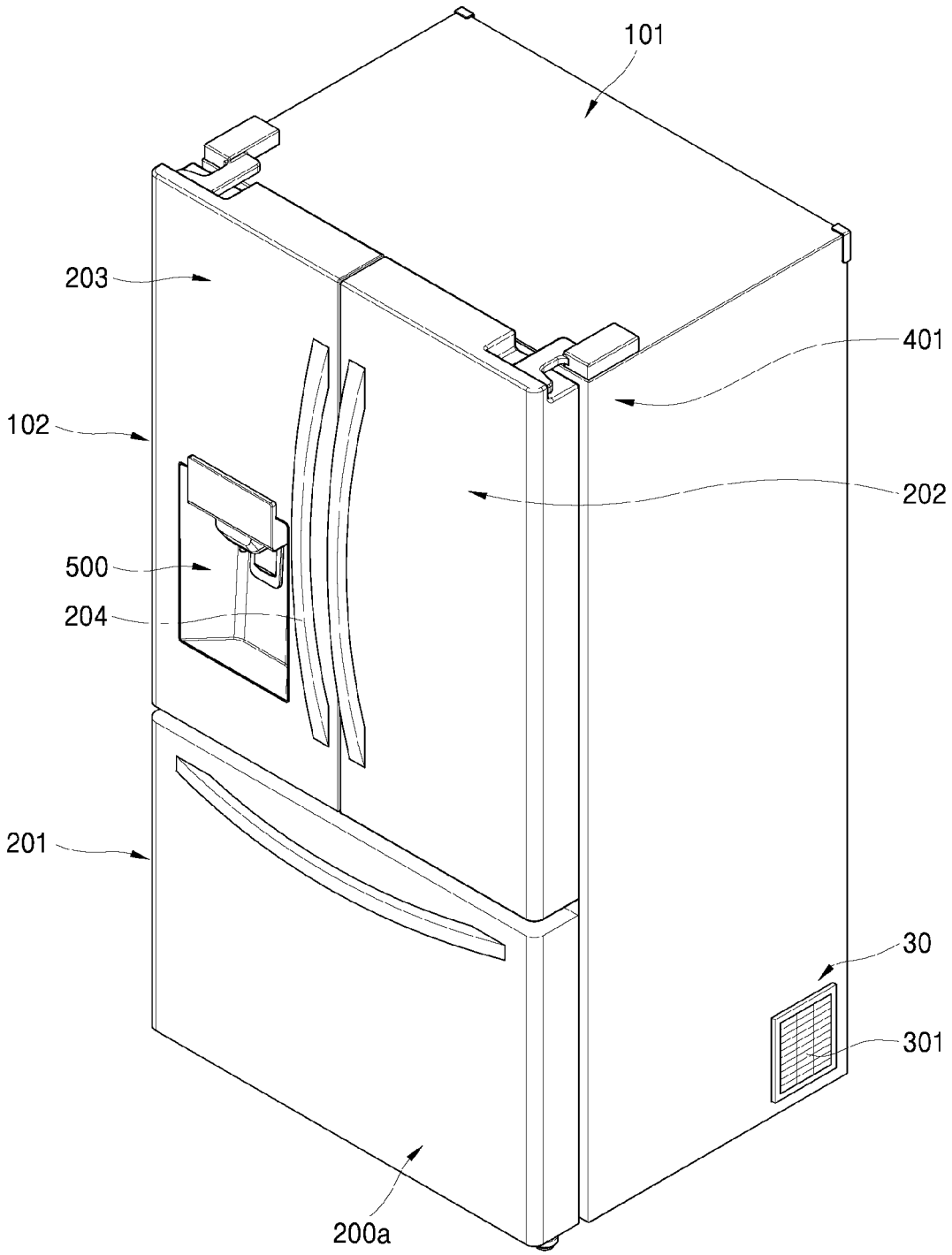

【FIG. 14】
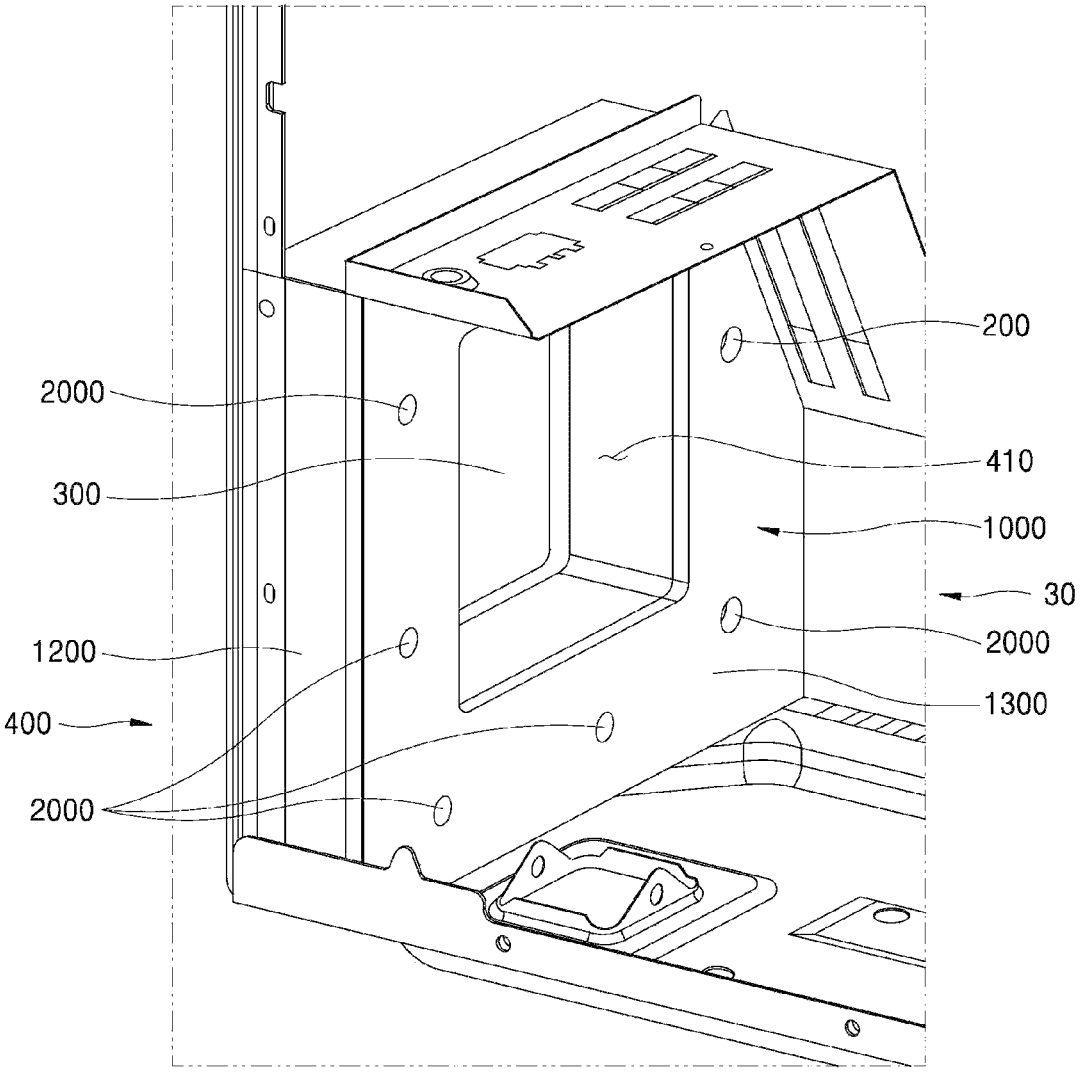

【FIG. 15】
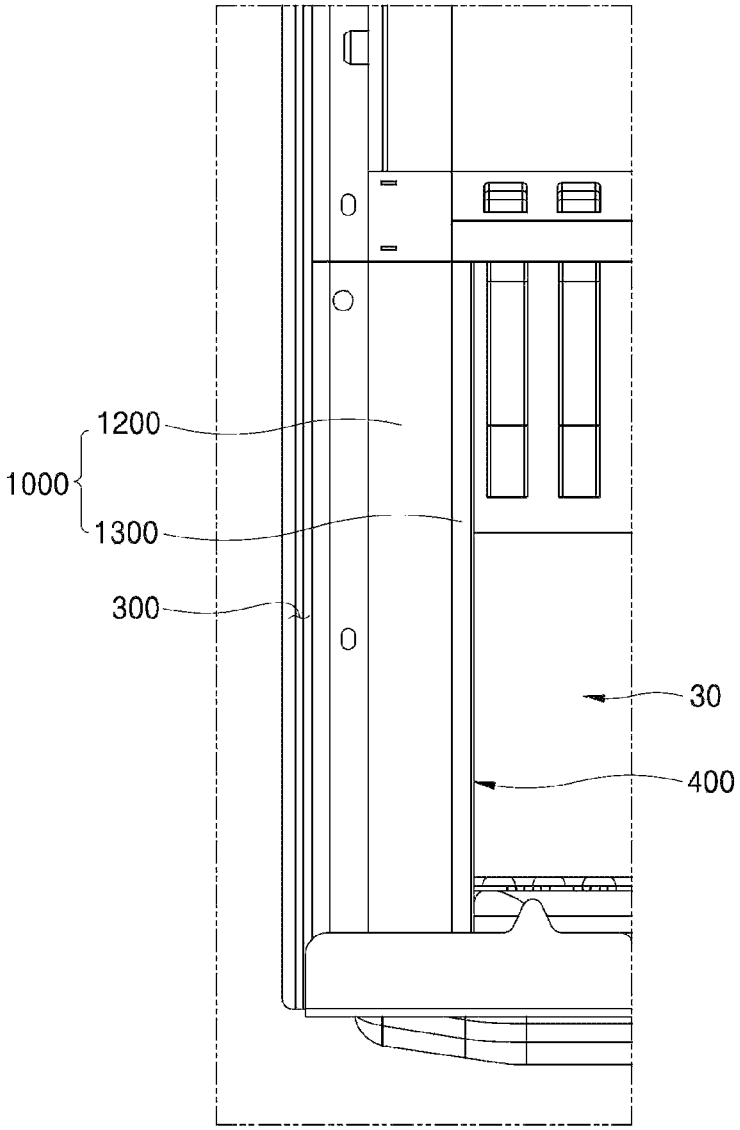

【FIG. 16】
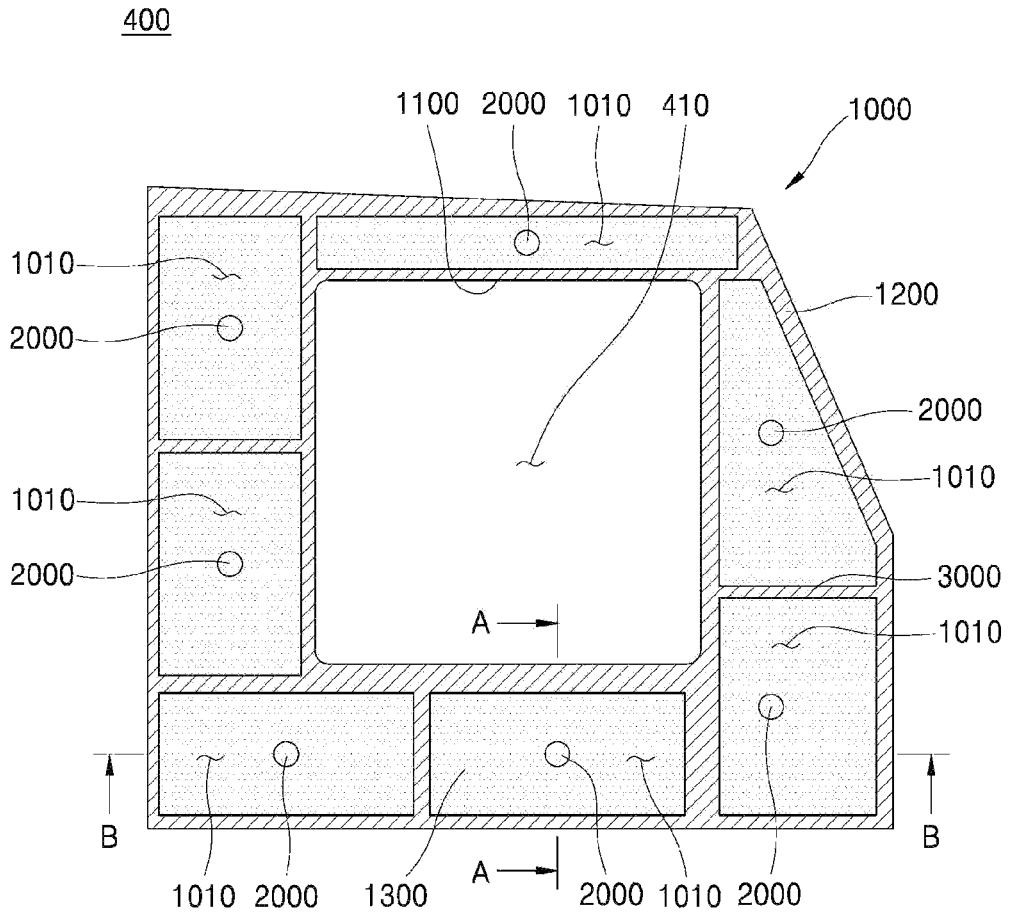

【FIG. 17】
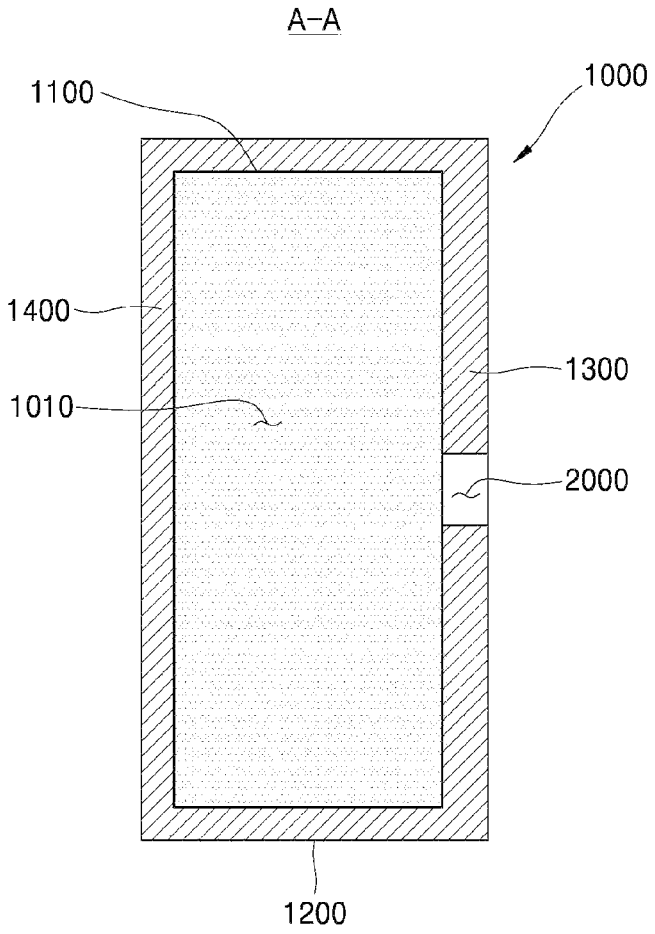

【FIG. 18】
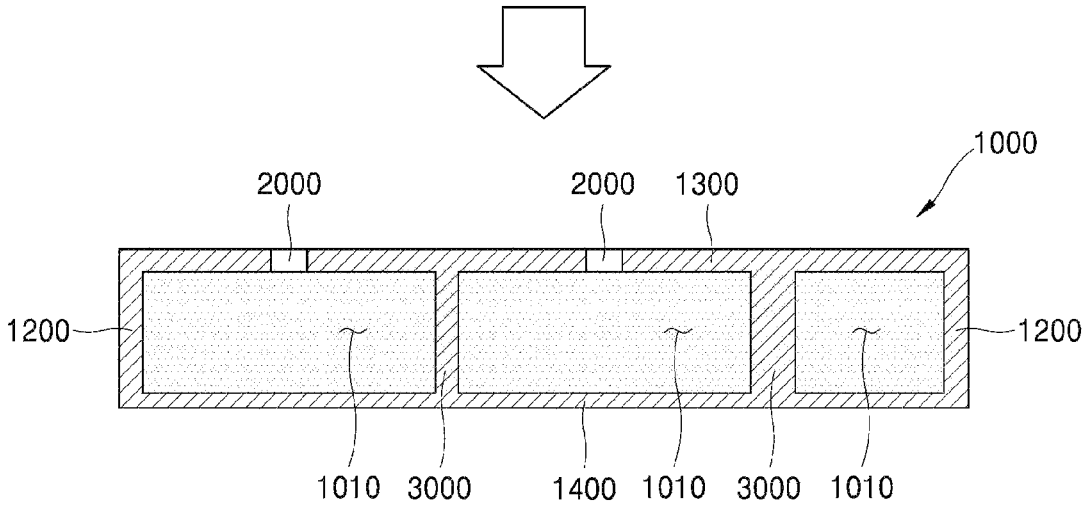
B-B

【FIG. 19】
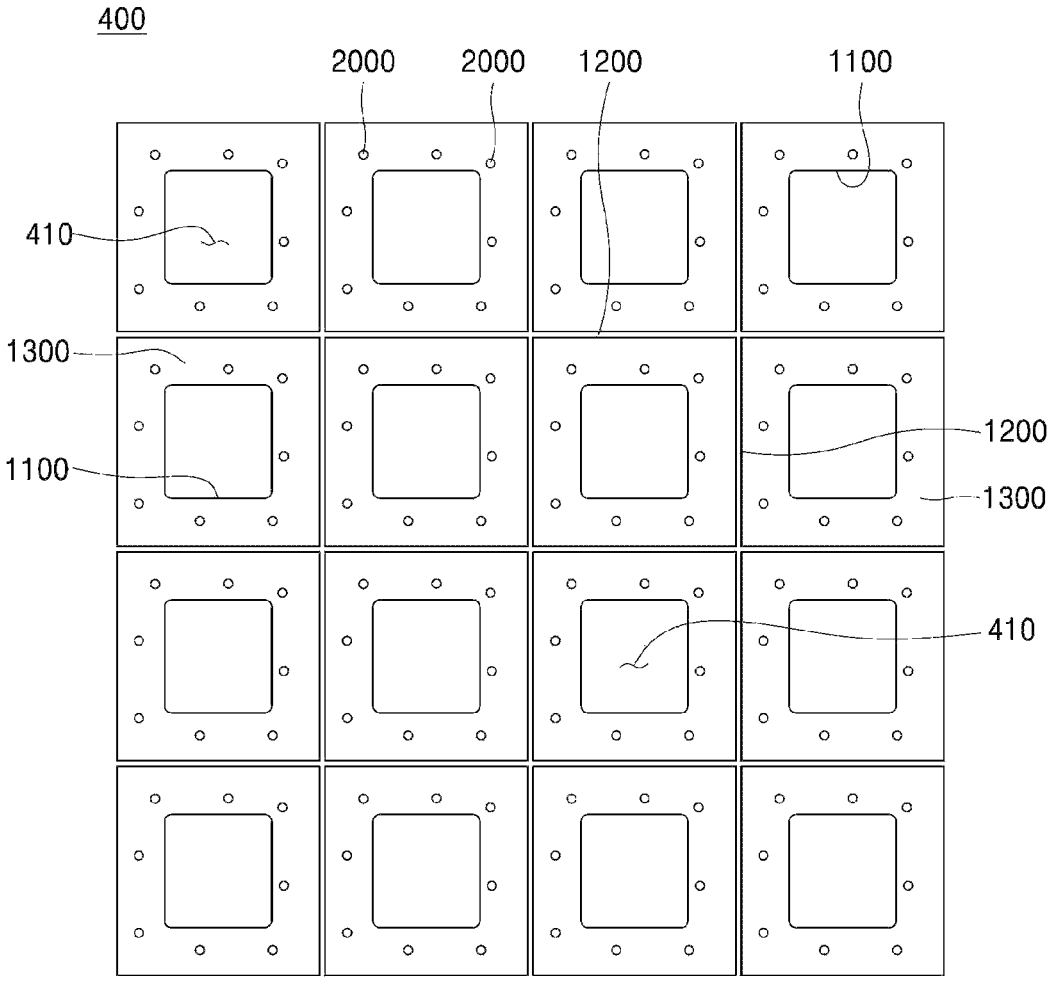

【FIG. 20】
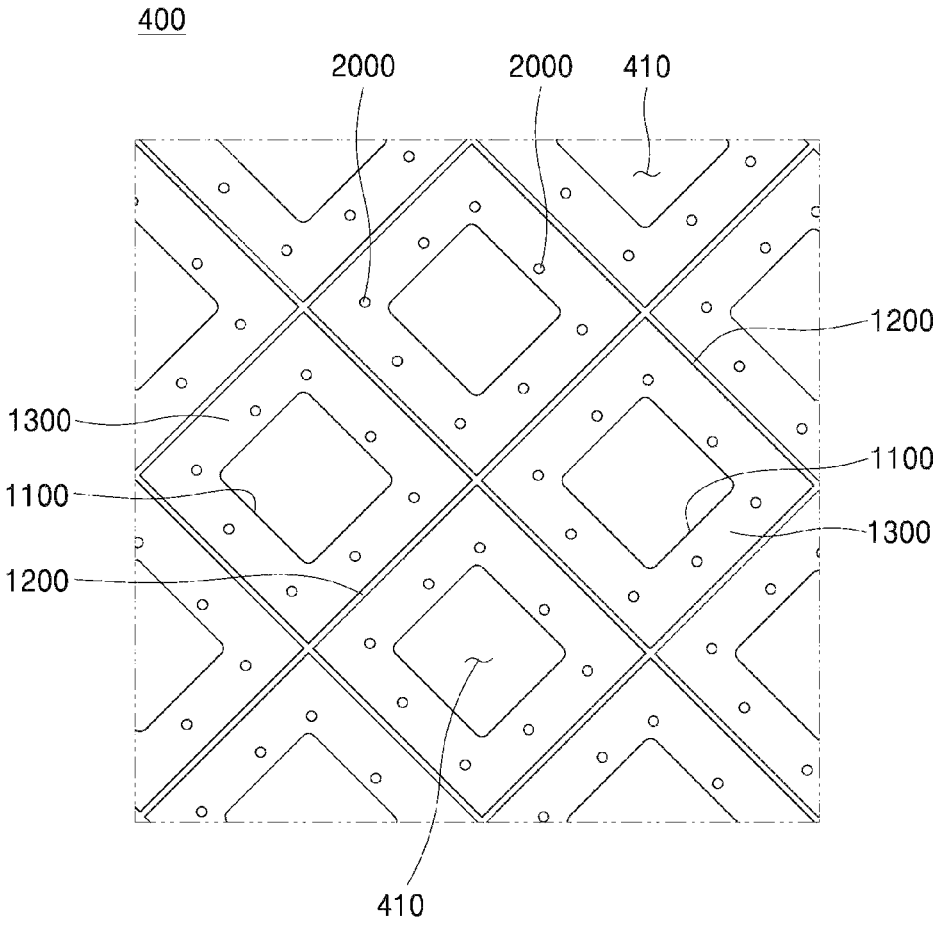

REFRIGERATOR AND NOISE-REDUCING DEVICE MOUNTED THERETO

CROSS-REFERENCE TO RELATED APPLICATIONS

This application is a National Stage Application under 35 U.S.C. § 371 of International Application No. PCT/KR2022/000373, filed on Jan. 10, 2022, which claims the benefit of priority to Korean Application Nos. 10-2021-0019061, and 10-2021-0019060, each filed on Feb. 10, 2021. The disclosures of the aforementioned applications are incorporated by reference in their entirety.

TECHNICAL FIELD

The present disclosure relates to a noise-reducing device for a refrigerator that can effectively reduce noise generated by a compressor while dissipating heat generated in the compressor to the outside, and a refrigerator including the same.

BACKGROUND

A refrigerator may include a compressor for compressing a refrigerant to a high temperature and high pressure refrigerant, a condenser for radiating heat from the refrigerant transferred from the compressor and converting it into high temperature and high pressure liquid refrigerant, a capillary tube for converting the high temperature and high pressure refrigerant into a low temperature and low pressure refrigerant while it passing therethrough after passing through the condenser, and an evaporator for exchanging heat with air while evaporating the low temperature and low pressure refrigerant through the capillary tube.

The compressor, the condenser, and the like may be disposed in a mechanism chamber provided inside a refrigerator body. The compressor generates heat during the driving. A refrigerator may have a ventilation hole for discharging the heat, which remains in the mechanism chamber after generated by the compressor, to the outside.

A refrigerator may include a mechanism chamber in which the compressor, a motor for operating the compressor, and the like are disposed. Devices such as the compressor, the motor and the like might generate significant noise. Accordingly, for user's convenience, a device capable of reducing noise generated by the devices disposed in the mechanism is needed in a refrigerator.

In particular, the compressor may generate noise during the operation, and the generated noise causes inconvenience to the user. Accordingly, the noise generated by the compressor should be reduced.

FIG. 1 is a view showing an example of a refrigerator. The reference numerals represented in FIG. 1 are limited to only the components of FIG. 1.

Referring to FIG. 1, the refrigerator includes a mechanism chamber 10 for reducing noise and vibration of a heat radiation device for a refrigerator. Here, to reduce noise and vibration generated by a compressor 21 and a blower unit 22, an inner wall of a case 11 has a shape curved a number of times, and the case 11 is supported by a plurality of dust-proof spheres 30. The refrigerator may reduce the noise and vibration generated by the compressor 21 and the blower unit 22, which constitute a heat radiation device. A curved shape E may reduce the noise discharged through an outlet path. However, the noise reduction effect may be insignificant.

FIG. 2 is a view showing another example of a refrigerator. The reference numerals represented in FIG. 1 are limited to only the components of FIG. 2

Referring to FIG. 2, the refrigerator includes a double wall 131 spaced a preset distance apart from an inner wall 110 of a mechanism chamber 100 of a kimchi refrigerator so that the sound absorption rate may be increased due to an empty space S formed between the double wall and the inner wall to absorb the noise generated in the mechanism chamber 110, thereby reducing the driving noise emitted to the outside of the kimchi refrigerator.

However, the refrigerator of FIG. 2 may not be suitable for reducing noise of low frequency (e.g., 500 Hz or less) of the compressor, because the size of the space between the double walls 131 and the size of the ventilation hole 132 are small. In addition, due to the small size of the ventilation hole 132, there might be acoustic impedance mismatch and then an effective noise reduction effect is not generated.

SUMMARY

The present disclosure describes a refrigerator that can discharge heat generated inside a mechanism chamber by driving of a compressor and reduce noise generated by driving of the compressor from being transmitted to a user, and a noise-reducing device provided therein.

The present disclosure further describes a refrigerator having a structure configured to effectively reduce noise generated in a mechanism chamber.

The present disclosure further describes a refrigerator having a structure configured to effectively reduce noise with various frequencies.

According to one aspect of the subject matter described in this application, a refrigerator includes a mechanism chamber having a lateral wall that defines a ventilation hole configured to discharge air from the mechanism chamber to an outside of the mechanism chamber, and a noise-reducing device that is disposed adjacent to the ventilation hole and defines a communication hole in communication with the ventilation hole. The noise-reducing device has a hollow shape with a predetermined inner space, and includes a frame that defines a plurality of hollow portions that are arranged around the ventilation hole.

Implementations according to this aspect can include one or more of the following features. For example, the frame defines a through-hole that communicates air between the plurality of hollow portions and the outside. In some examples, the through-hole is one of a plurality of through-holes, and the plurality of through-holes are arranged to surround the communication hole, each of the plurality of through-holes having a predetermined depth.

In some implementations, the noise-reducing device is attached to the lateral wall of the mechanism chamber. In some examples, the through hole faces an inside of the mechanism chamber. In some implementations, the frame includes a first piece that is disposed inside the noise-reducing device and defines the communication hole, a second piece that defines an outside of the noise-reducing device, and a third piece that couples the first piece to the second piece, where the third piece defines the through-hole.

In some implementations, the refrigerator can include a partition wall that is coupled to the first piece, the second piece, and the third piece of the frame to thereby partition the frame into the plurality of hollow portions. In some examples, a volume of at least one of the plurality of hollow portions is different from a volume of another of the plurality of hollow portions. In some examples, the noise-reducing device is one of a plurality of noise-reducing devices, where each of the plurality of noise-reducing devices defines one communication hole in communication with the ventilation hole. In some examples, the plurality of noise-reducing devices are coupled to one another, and the second piece partitions the plurality of noise-reducing devices.

According to another aspect, a noise-reducing device is configured to be disposed at a first lateral surface of a mechanism chamber of a refrigerator, where the first lateral surface defines a first hole. The noise-reducing device includes a plurality of covers that define a resonance chamber and are configured to be disposed at a position corresponding to the first hole defined at the first lateral surface of the mechanism chamber, where the plurality of covers have a shape corresponding to the first hole. The noise-reducing device further includes an acoustic filter that passes through the resonance chamber and has a hollow tube shape, where the noise-reducing device defines one or more holes that are in communication with the first hole defined at the first lateral surface of the mechanism chamber.

Implementations according to this aspect can include one or more of the following features. For example, the plurality of covers include a first cover that is configured to be in contact with the first lateral surface of the mechanism chamber, the first cover defining a second hole in communication with the first hole, and a second cover that faces the first cover and defines a third hole. The acoustic filter connects between the second hole and the third hole, where the first hole, the second hole, and the third hole are in communication with one another through the acoustic filter.

In some examples, shapes of the first and second holes are identical, where the acoustic filter has (a) a first end having a first shape corresponding to the first hole and the second hole and (ii) a second end having a second shape corresponding to the third hole. The acoustic filter is configured to discharge heat generated by a machine component disposed inside the mechanism chamber to an outside of the mechanism chamber through the first hole, the second hole, and the third hole. The resonance chamber is configured to diffract and resonate noise that is generated by the machine component and transmitted into the resonance chamber through the acoustic filter.

In some examples, the first hole, the second hole, and the third hole have a circular shape. In some examples, sizes of the second hole and the third hole are identical, where the acoustic filter has a cylindrical shape. In some examples, a size of the second hole is less than a size of the third hole, where the acoustic filter has a conical shape.

In some implementations, the first hole is one of a plurality of first holes defined at the first later surface of the mechanism chamber, the second hole is one of a plurality of second holes defines at the first cover, and the third hole is one of a plurality of third holes defined at the second cover. The acoustic filter is one of a plurality of acoustic filters, where each of the plurality of acoustic filters connects between one of the plurality of second holes and a corresponding one of the plurality of third holes, and the plurality of first holes, the plurality of second holes, and the plurality of third holes are arranged in a matrix shape.

In some examples, the second cover has a concave shape that is recessed toward the third hole. In some examples, the acoustic filter is made of non-woven fabric. In some examples, the refrigerator includes a storage compartment, and a lower area of a rear surface of the storage compartment is inclined, where the mechanism chamber is defined in the lower area of the rear surface of the storage compartment. The plurality of covers further include a third cover that faces the lower area of the rear surface of the storage compartment, the third cover being inclined to thereby avoid interference with the lower area of the rear surface of the storage compartment.

In some implementations, the refrigerator can dispose the noise-reducing device, in which a tube-shaped acoustic filter is inserted into a hollow resonance chamber, on a lateral surface of a mechanical chamber, thereby discharging heat due to driving of a compressor to the outside of a mechanism chamber and reducing noise of the compressor from being transmitted to the outside of the mechanism chamber thorough diffraction and resonating at the same time. Accordingly, the failure of the refrigerator can be reduced, and the user's inconvenience caused by noise can be solved.

In some implementations, the noise-reducing device provided in the mechanism chamber can act as Helmholtz resonator and absorb noise generated in the mechanism chamber, thereby effectively weakening the noise.

In some implementations, in the refrigerator, the plurality of hollow portions provided in the noise-reducing device can have different volumes from each other, and the through-holes corresponding to the hollow portions can have different cross-sectional areas from each other.

Due to this structure, the noise-reducing device can have a plurality of various resonance frequencies. Since the noise-reducing device has the plurality of various resonance frequencies, noise with various frequencies generated in a noise generating device can be effectively reduced.

Specific effects are described along with the above-described effects in the section of Detailed Description.

BRIEF DESCRIPTION OF DRAWINGS

FIGS. 1 and 2 are views showing example refrigerators in related art.

FIG. 3 is a block view showing an example of a refrigerant cycle of a refrigerator.

FIG. 4 is a perspective view showing an example of a refrigerator.

FIGS. 5A and 5B show a perspective view and a sectional view showing an example of a noise-reducing device.

FIGS. 6A and 6B is a sectional view showing an example of a refrigerator in which the noise-reducing device shown in FIGS. 5A and 5B are installed in a lower portion of a left case.

FIGS. 7A and 7B shows a perspective view and a sectional view showing an example of a noise-reducing device.

FIGS. 8A and 8B is a sectional view showing an example of a refrigerator in which the noise-reducing device shown in FIGS. 7A and 7B is installed in a lower portion of a left case.

FIGS. 9A and 9B shows a perspective view and a sectional view showing an example of a noise-reducing device.

FIGS. 10A and 10B is a sectional view showing an example of a refrigerator in which the noise-reducing device shown in FIGS. 9A and 9B is installed in a lower portion of a left case.

FIGS. 11A and 11B shows a perspective view and a sectional view showing an example of a noise-reducing device.

FIGS. 12A and 12B are sectional views showing an example of a refrigerator in which the noise-reducing device shown in FIGS. 9A and 9B is installed in a lower portion of a left case.

FIG. 13 is a schematic view showing an example of a refrigerator.

FIG. 14 is a view partially showing an example of a mechanism chamber of a refrigerator.

FIG. 15 is a side sectional view of FIG. 14.

FIG. 16 is a side view an example of a noise-reducing device.

FIG. 17 is a sectional view showing AA of FIG. 16.

FIG. 18 is a sectional view showing BB of FIG. 16.

FIG. 19 is a view showing an example structure in which a plurality of noise-reducing devices are coupled.

FIG. 20 is a view showing another example structure in which a plurality of noise-reducing devices are coupled.

DETAILED DESCRIPTION

Hereinafter, one or more examples of a refrigerator will be described in detail.

FIG. 3 is a block view showing an example of a refrigerant cycle of a refrigerator, and FIG. 4 is a perspective view showing an example of a refrigerator.

Referring to FIGS. 3 and 4, a refrigerator can include a body 1 in which a storage compartment 120 (see FIGS. 6, 8 and 10) for storing foods is formed; and a cooling system for cooling the storage compartment 120.

The body 1 can have an exterior design defined by a case. The case can include an upper case 2, a lower case 3, a left case 4, a right case 5, and a rear case 6. A door can be coupled to an upper surface of the body 1.

The cooling system of the refrigerator can include a compressor 10 that compresses a refrigerant, a condenser 20 that exchanges heat with external air and condenses the heat-exchanged air; an expansion mechanism 12 that expands the refrigerant, and an evaporator 13 that evaporates the refrigerant through heat exchange with air inside the refrigerator.

The refrigerant compressed by the compressor 10 can be condensed by heat exchange with outdoor air while passing through the condenser 20. The condenser 20 can be disposed in the mechanism chamber 130 formed in the body 1.

The refrigerant condensed by the condenser fan 15 can flow to the expansion mechanism 12 to be expanded. The refrigerant expanded by the expansion mechanism 12 can exchange heat with indoor air to be evaporated while passing through the evaporator 13. The evaporator 13 can be disposed for heat exchange with air inside the storage compartment 120 (see FIGS. 6, 8 and 10).

The refrigerant evaporated by the evaporator 13 can be collected in the compressor 10. An evaporator fan 16 can be provided to blow indoor air to the evaporator 13. The refrigerant circulates through the condenser 20, the expansion mechanism 12 and the evaporator 13 to operate in a cooling cycle.

A compressor suction path for guiding the refrigerant passing through the evaporator 13 to the compressor 10 can be connected to the compressor 10. An accumulator 14 can be disposed in the compressor suction path to accumulate the refrigerant.

The mechanism chamber 130 can be disposed in a rear lower area of the body 1. The mechanism chamber 130 can have a shape extending to both lateral surfaces along a rear surface of the body 1.

To maximize the space of the storage compartment 120 of the refrigerator, the left-right length of the mechanism chamber 130 can be formed to match the left-right length of the main body 1. The up-down direction height of the mechanism chamber 130 can be longer than the front-rear direction width of the mechanism chamber 130.

A first hole 41 can be formed in some area of a case disposed adjacent to the compressor 10, that is, on a lower surface of a left case 4. The first hole 41 can be formed to discharge heat generated in the compressor 10. For example, the first hole 41 can have a circular shape.

In some implementations, a noise-reducing device 100 can be defined in some area of the case disposed adjacent to the compressor 10, for example, at a lower area of the left case 4. Here, the lower area of the left case 4 can correspond to a first lateral surface of the mechanism chamber 130.

The noise-reducing device 100 can serve a function of discharging air inside the mechanism chamber 100 to the outside thereof and a function of reducing noise generated in the mechanism chamber 130 from being transferred to the outside of the mechanism chamber 130.

Hereinafter, referring to FIGS. 5 to 12, the structure of the noise-reducing device 100 will be described in detail.

FIGS. 5A and 5B shows a perspective view and a sectional view of a noise-reducing device. FIGS. 6A and 6B is a sectional view showing a refrigerator in which the noise-reducing device shown in FIG. 5 is installed in a lower portion of a left case (i.e., a first lateral surface of the mechanism chamber 130).

Referring to FIGS. 5A through 6B, the noise-reducing device 100 can include a resonance chamber 200 and an acoustic filter 300. The resonance chamber 200 can be disposed adjacent to the first lateral surface of the mechanism chamber 130 and can include a plurality of covers with an empty inside.

The resonance chamber 200 can include a plurality of covers with an empty space. The plurality of covers can have a flat shape. The resonance chamber 200 can be disposed adjacent to the compressor 10 not to interfere with the compressor 10 (see FIGS. 6A and 6B).

The first hole 41 can be defined in the first lateral surface of the mechanism chamber 140, and the plurality of covers can be provided at a position corresponding to the first hole 41, with a shape corresponding to the first hole 41, and can have holes in communication with the first hole 41. The holes can include a second hole 211 and a third hole 221.

The second hole 211 can be defined on a first cover 210 in contact with the lower area of the left case 4 (i.e., the first lateral surface of the mechanism chamber 130) among the plurality of covers. The second hole 211 can have the same shape as the first hole 41. As one example, the second hole 211 can have a circular shape.

The third hole 221 can be defined on a second cover 220 corresponding to the first cover 210 among the plurality of covers. The third hole 221 can have the same shape as the second hole 211. As one example, the third hole 221 can have a circular shape.

In some examples, the resonance chamber 200 can have a shape not interfering with the storage compartment 120. More specifically, referring to FIGS. 6A and 6B, a lower area of a rear surface of the storage compartment 120 can be inclined in order to form the mechanism chamber 140 inside the main body 1. In this instance, the resonance chamber 200 should not interfere with the lower area of the rear surface of the storage compartment 120. Accordingly, among the plurality of covers, a third cover 230 facing the lower area of the rear surface of the storage compartment 120 can be inclined.

The acoustic filter 300 can be disposed in an axial direction of the first hole 41, and can perform acoustic impedance matching. The acoustic filter 300 can be made of non-woven fabric, but the material of the acoustic filter 300 is not limited thereto.

The acoustic filter 300 can have a hollow tube shape and can be disposed to pass through the resonance chamber 200. That is, the acoustic filter 300 can be disposed between the second hole 211 and the third hole 221.

One end of the acoustic filter 300 can have the same shape as the second hole 211 and the other end thereof can have the same shape as the third hole 221. One end of the acoustic filter 300 can be connected with the second hole 211 and the other end of the acoustic filter 300 can be connected with the third hole 221. Accordingly, the first hole 41, the second hole 211 and the third hole 221 can be in communication through the acoustic filter 300. When the second hole 211 and the third hole have the circular shape, the acoustic filter 300 can have a cylindrical shape.

The heat discharge function and the noise reduction function of the noise-reducing device 100 will be described.

The compressor 10 disposed inside the mechanism chamber 130 can discharge heat during the operation and generate noise. Accordingly, in order to prevent malfunctioning of the refrigerator, air inside the mechanism chamber 130 can be discharged to the outside, and less driving noise of the compressor 10 can be transmitted to the user.

In order to discharge heat to the outside from the mechanism chamber 130, the noise-reducing device 100 can have a shape in which the tub-shaped acoustic filter 300 pass through the resonance chamber 200. Then, air inside the mechanism chamber 130 (i.e., hot air) can be effectively discharged to the outside of the mechanism chamber 130 through the acoustic filter 300 and the first hole 41. In other words, the noise-reducing device 100 can perform the function corresponding to that of a ventilation opening.

The noise generated inside the mechanism chamber 130 can be absorbed by the acoustic filter 300 and introduced into the resonance chamber 200. In some examples, the noise, which is a wave, is simultaneously diffracted and resonated inside the hollow resonance chamber 200. Due to the diffraction and resonance effects, the noise of the compressor 10 may not be transmitted to the outside of the mechanism chamber 130 or is transmitted to a small extent. Accordingly, the noise of the compressor 10 can be less audible to the user, which is an advantage of the present disclosure.

The noise of the compressor 10 is most audible to the user in a specific frequency band. As an example, the specific frequency band can be a low frequency band and the peak frequency can be 470 Hz. Accordingly, the noise-reducing device 100 can reduce the noise at the peak frequency by adjusting the thickness of the resonance chamber 200 (i.e., the width of the third cover 230 or the internal volume of the resonance chamber 200) and the size of the second and third holes 211 and 221 (i.e., the radius). As one example, when the peak frequency is 470 Hz, the thickness of the resonance chamber 200 can be 12 cm and radius of the second and third holes 211 and 221 can be 5 cm.

FIGS. 7A and 7B show a perspective view and a sectional view of a noise-reducing device. FIGS. 8A and 8B is a sectional view of a refrigerator in which the noise-reducing device shown in FIGS. 7A and 7B is installed in a lower portion of a left case 4 (a first lateral surface of the mechanism chamber 130).

Referring to FIGS. 7A through 8B, the noise-reducing device 100 can include a resonance chamber 200 and a plurality of acoustic filters 300.

The resonance chamber 200 can include a plurality of covers and can have a hollow shape. The plurality of covers can have a flat shape. The resonance chamber 200 can be disposed adjacent to the compressor 10 not to interfere with the compressor 10 (see FIGS. 8A and 8B). The resonance chamber 200 can have a shape not interfering with the storage compartment 120.

Among the plurality of covers, a first cover 210 can include a plurality of second holes 211. The plurality of second holes 211 can be arranged in a matrix shape. In some examples, a plurality of first holes 41 can also be defined even on a lower surface of the left case 4. The plurality of first holes 41 can also be arranged in a matrix shape. The plurality of second holes 211 can have the same shape as the plurality of first holes 41. As one example, the plurality of first holes 41 and the plurality of second holes can have a circular shape.

Among the plurality of covers, a second cover 220 can have a plurality of third holes 221. The plurality of third holes 221 can be arranged in a matrix shape. The plurality of third holes 221 can have the same shape as the plurality of second holes 211. As one example, the plurality of third holes 221 can have a circular shape.

Each of the plurality of acoustic filters 300 can be disposed in an axial direction of a corresponding first hole 41, and can perform acoustic impedance matching. The plurality of acoustic filters 300 can be made of non-woven fabric.

Each of the plurality of acoustic filters 300 can have a hollow tube shape that passes through the resonance chamber 200. That is, each of the plurality of acoustic filters 300 can be disposed between corresponding second and third holes 211 and 221.

In some implementations, one end of each of the plurality of acoustic filters 300 has the same shape as the corresponding second hole 211. The other end of each of the plurality of acoustic filters 300 has the same shape as the corresponding third hole 221. Accordingly, the corresponding first hole 41, the corresponding second hole 211 and the corresponding third hole 221 can be in communication through each of the plurality of acoustic filters 300. When the second hole 211 and the third hole 221 have the circular shape, the acoustic filter 300 can have a cylindrical shape.

The noise-reducing device can perform a heat discharge function and a noise reduction function in the same manner as the noise-reducing device 100 described above. However, unlike the noise-reducing device 100, the noise-reducing device 100 can include the plurality of acoustic filters 300. Since the plurality of acoustic filters 300 is provided, the diffraction phenomenon performed inside the resonance chamber 200 can be maximized.

FIGS. 9A and 9B shows a perspective view and a sectional view of a noise-reducing device. FIGS. 10A and 10B are sectional views showing a refrigerator in which the noise-reducing device shown in FIG. 9 is installed in a lower portion of a left case 4 (i.e., a first lateral surface of the mechanism chamber 130).

Referring to FIGS. 9A through 10B, the noise-reducing device 100 can include a resonance chamber 200 and an acoustic filter 300.

The resonance chamber 200 can include a plurality of covers and can have a hollow shape. The plurality of covers can have a flat shape. The resonance chamber 200 can be disposed adjacent to the compressor 10 not to interfere with the compressor 10 (see FIGS. 10A and 10B). The resonance chamber 200 can have a shape not interfering with the storage compartment 120.

Among the plurality of covers, a first cover 210 can include a second hole 211. The second hole 211 can have the same shape as the first hole 41. As one example, the second holes can have a circular shape.

Among the plurality of covers, a second cover 220 can have a third hole 221. The third hole 221 can have the same shape as the second hole 211. As one example, the third hole 221 can have a circular shape.

In the noise-reducing device, the third hole 221 can have a large size (i.e., radius) than the second hole 211, which will be described in detail later.

The acoustic filter 300 can be disposed in an axial direction of the first hole 41, and can perform acoustic impedance matching. The acoustic filter 300 can be made of non-woven fabric.

The acoustic filter 300 can have a hollow tube shape that passes through the resonance chamber 200. That is, the plurality of acoustic filter 300 can be disposed between the second hole 211 and the third hole 221.

In some implementations, one end of the acoustic filter 300 can have the same shape as the second hole 211 and the other end of the acoustic filter 300 can have the same shape as the third hole 221. Accordingly, the first hole, 41, the second hole 211 and the third hole 221 can be in communication through the acoustic filter 300. When the second hole and the third hole have the circular shape, the acoustic filter 300 can have a cylindrical shape.

The noise-reducing device 100 can perform a heat discharge function and a noise reduction function in the same manner as the noise-reducing device 100 described above. However, unlike the noise-reducing device 100, the noise-reducing device 100 can include the acoustic filter 300 having the other end larger than one end (that is, a conical-shaped acoustic filter 300).

Since the other end of the acoustic filters 300 is formed larger, the thickness (i.e., the internal volume) of the resonance chamber 200 can be increased and a problem of interference between the resonance chamber 200 and the components of the compressor 10 can be solved at the same time. In addition, since the other end of the acoustic filter 300 is formed larger, the noise of the compressor 10 can be better absorbed into the resonance chamber 200 and the axial length and cross-sectional area of the third hole 221 can be increased, thereby further reducing the noise.

FIGS. 11A and 11B shows a perspective view and a sectional view of a noise-reducing device. FIGS. 12A and 12B are sectional views showing a refrigerator in which the noise-reducing device shown in FIGS. 9A and 9B is installed in a lower portion of a left case 4 (i.e., a first lateral surface of the mechanism chamber 130).

Referring to FIGS. 11 and 12, the noise-reducing device 100 can include a resonance chamber 200 and an acoustic filter 300.

The resonance chamber 200 can include a plurality of covers and can have a hollow shape. The plurality of covers can have a flat shape. The resonance chamber 200 can be disposed adjacent to the compressor 10 not to interfere with the compressor 10 (see FIGS. 12A and 12B). The resonance chamber 200 can have a shape not interfering with the storage compartment 120.

In some implementations, the plurality of covers can have a flat shape, except a second cover 220.

Among the plurality of covers, a first cover 210 can include a second hole 211. The second hole 211 can have the same shape as the first hole 41. As one example, the second holes can have a circular shape.

Among the plurality of covers, a second cover 220 can have a third hole 221. As one example, the third hole 221 can have a circular shape. The third hole 221 can have the same shape as the second hole 211. As one example, the third hole 221 can have a circular shape.

Especially, the second cover 220 can have a shape recessed with respect to the third hole 221. That is, an edge area of the second cover 220 can protrude toward the inside of the mechanism chamber 130, rather than the center area of the second cover 220. The edge area of the second cover 220 and the center area of the second cover 220 can be connected in a curved shape.

The acoustic filter 300 can be disposed in an axial direction of the first hole 41, and can perform acoustic impedance matching. The acoustic filter 300 can be made of non-woven fabric.

The acoustic filter 300 can have a hollow tube shape that passes through the resonance chamber 200. That is, the plurality of acoustic filter 300 can be disposed between the second hole 211 and the third hole 221.

In some examples, one end of the acoustic filter 300 can have the same shape as the second hole 211 and the other end of the acoustic filter 300 can have the same shape as the third hole 221. Accordingly, the first hole, 41, the second hole 211 and the third hole 221 can be in communication through the acoustic filter 300. When the second hole and the third hole have the circular shape, the acoustic filter 300 can have a cylindrical shape.

The noise-reducing device 100 can perform a heat discharge function and a noise reduction function in the same manner as the noise-reducing device 100 described above. However, unlike the noise-reducing device 100, the noise-reducing device 100 can include the second cover 220 having the recessed shape.

Since the second cover 220 has the recessed shape, the problem of interference between the compressor 10 and the resonance chamber 200 can be more reliably solved. In addition, the acoustic filter 300 having the other end larger than one end (that is, a conical-shaped acoustic filter 300). In addition, due to the recessed second cover 220, the volume of the resonance chamber 200 can be increased, thereby further reducing the noise.

FIG. 13 is a schematic view showing an example of a refrigerator. First, referring to FIG. 13, an overall structure of a refrigerator will be described.

The refrigerator can include a cabinet 101 that defines an exterior design. A refrigerator compartment 102 can be provided in an upper portion of the cabinet 101 and a freezer compartment 201 can be provided in a lower portion of the cabinet, the refrigerator can include a refrigerator compartment 102 provided in a lower portion of the cabinet 101 and a freezer compartment 201 mounted on a top of the refrigerator compartment inside the cabinet. Hereinafter, a structure in which the refrigerator compartment 102 is mounted in an upper portion and the freezer compartment 201 is mounted under the refrigerator compartment 102 will be exemplified.

To open and close the refrigerator compartment 102, doors 202 and 203 can be rotatably coupled to the upper portion of the cabinet 101 by a hinge member 401. In some implementations, two doors 202 and 203 for opening and closing the refrigerator compartment 102 are shown, but the implementation is not limited thereto. It is possible to use one door.

A handle 204 can be provided in the doors 202 and 203 so that the user can rotate the doors 202 and 203. The shapes or structure of the handle 204 is not limited what is shown in the drawings, and various structures can be selected.

A dispenser 500 can be provided in a predetermined area of the door 203 to supply water or ice to the user. A lower door 200*a* for opening and closing the freezer compartment 201 can be provided in the lower portion of the cabinet 101.

However, the dispenser 500 is not an essential component of the refrigerator, and the refrigerator can have a structure having no dispenser 500.

The mechanism chamber 30 can be disposed in a side portion of the refrigerator compartment 102. In the mechanism chamber 30 can be disposed a compressor for compressing a refrigerant, a motor for operating the compressor, etc. Such the compressor, motor, etc. can be noise generating devices that cause noise.

The mechanism chamber 30 can be provided with a ventilation hole 301 and a noise-reducing device 400. The ventilation hole 301 can be formed through a lateral wall of the mechanism chamber 30 and can form an air flow path to the outside. In some examples, a mesh can be disposed in the ventilation hole 301 to suppress relatively large foreign substances from flowing into the mechanism chamber 30 and to keep the user safe. The noise-reducing device 400 can have a communication hole in communication with the ventilation hole 301.

The noise-reducing device 400 can be disposed adjacent to the ventilation hole 301 and can have the communication hole 410 in communication with the ventilation hole 301, with at least predetermined inner empty area.

The noise-reducing device 400 can be attached to the lateral wall of the mechanism chamber 30. Accordingly, the noise-reducing device 400 can be attached to the lateral wall of the mechanism chamber 30 so that the communication hole 410 can be in communication with the ventilation hole of the mechanism chamber 30. Accordingly, the noise-reducing device 400 can be disposed not to interfere with air flow between the inside and the outside of the mechanism chamber 30.

The noise-reducing device 400 can include a frame 1000 forming a hollow portion 1010, and a through-hole 2000 penetrating the frame 1000 to enable communication between the hollow portion 1010 and the outside. The frame 1000 can define a plurality of hollow portions 1010 and the plurality of hollow portions 1010 can surround the communication hole 410.

The noise-reducing device 400 can be Helmholtz resonator. the noise-reducing device 400 can serve to reduce the noise of the device disposed in the mechanism chamber 30 of the refrigerator and causing noise, for example, the compressor, the motor, etc. (hereinafter, referred to as 'the noise generating device').

When the Helmholtz resonator is disposed in a noise source, that is, the noise generating device, the Helmholtz resonator absorbs a specific frequency of a sound wave and cancel the sound wave through interference of the sound wave to reduce noise.

Specifically, the Helmholtz resonator can have a resonance frequency and cancel the frequency of a sound wave equal to the resonance frequency and the frequency of a sound wave reacting with the resonance frequency.

In some implementations, the structure in while the hollow portion 1010 and the through-hole 2000 of the noise-reducing device 400 are combined can work as Helmholtz resonator. the resonance frequency f of the Helmholtz resonator can be calculated by the following equation:

$$f = \frac{c}{2\pi}\sqrt{\frac{S}{VL}} \qquad \text{< Equation 1 >}$$

Where,

F: Resonance frequency Hz c: Speed of Sound wave m/s

S: Cross-sectional area m2 of Through-hole 2000

V: Volume m3 of Hollow portion 1010

L: Depth m of Through-hole 2000

In some examples, the combination of each hollow portion 1010 separated by a first piece 1100, a second piece 1200 and a third piece 1300 and the through-hole 2000 connected thereto can act as a resonator. The structure including the hollow portion 1010 and the through-hole 2000 can be each Helmholtz resonator. Accordingly, the noise-reducing device 400 can have a structure in which a plurality of Helmholtz resonators are combined. Hereinafter, the structure of the noise-reducing device 400 will be described in detail.

FIG. 14 is a view partially showing an example of a mechanism chamber of a refrigerator. FIG. 15 is a side sectional view of FIG. 14. FIG. 16 is a side view of a noise-reducing device. FIG. 17 is a sectional view showing AA of FIG. 16. FIG. 18 is a sectional view showing BB of FIG. 16.

In some implementations, the noise-reducing device 400 provided in the mechanism chamber 30 can act as the Helmholtz resonator to absorb and effectively weaken the noise generated in the mechanism chamber 30.

The hollow portion 1010 of the noise-reducing device 400 can be provided in plural. Each of the hollow portions 1010 can be disposed to surround the communication hole 410. Corresponding through-holes 2000 can be formed in the hollow portions 1010, respectively. Accordingly, the plurality of through-holes 2000 can be provided and each through-hole 2000 can be formed to surround the communication hole 410.

In some examples, the through-hole 2000 can have a predetermined depth. The noise-reducing device 400 can be designed to have a resonance frequency matching a frequency of a sound wave generated in the noise generating device, that is, a target frequency.

Accordingly, among the cross-sectional area of the through-hole 2000, the volume of the hollow portion 1010 and the depth of the through-hole 2000, the depth of the through-hole 2000 can be appropriately selected so that the noise-reducing device 400 can be designed to have a resonance frequency matching a target frequency.

Referring to FIGS. 14 and 18, the through-hole 2000 can be formed at an area of the frame 1000 of the noise-reducing device 400 facing the inside of the mechanism chamber 30. Accordingly, the noise generating device disposed inside the mechanism chamber 30 can be disposed to face the through-hole 2000.

That is, the through-hole 2000 can be formed in a direction opposite to the traveling direction of noise. An arrow shown in FIG. 18 indicates the traveling direction of noise generated from the noise generating device disposed in the mechanism chamber 30. Due to this structure, most of the noise generated in the mechanism chamber 30 can be directly introduced into the noise-reducing device 400 through the through-hole 2000 without going through reflection or diffraction, and can be reduced in the noise-reducing device 400.

Accordingly, the noise-reducing device 400 can suppress noise from being transmitted to the entire mechanism chamber 30 due to reflection, diffraction, etc. and eventually being discharged to the outside of the mechanism chamber 30, and can effectively reduce such the noise.

The frame 1000 can include a first piece 1100, a second piece 1200, a third piece 1300, a partition wall 3000 and a fourth piece 1400.

The first piece 1100 can be disposed inside the noise-reducing device 400 to form the communication hole 410. The second piece 1200 can be disposed outside the noise-reducing device 400. The third piece 1300 can be coupled to an end of the first piece and an end of the second piece 1200, and the through-hole 2000 can be formed thereon.

The partition wall 3000 can be coupled to the first piece 1100, the second piece 1200 and the third piece 1300 to partition the hollow portion 1010 into a plurality of hollow portions 1010. The fourth piece 1400 can be coupled to the first piece 1100, the second piece 1200 and the partition wall 3000, spaced a preset distance from the third piece to face the third piece 1300.

The first piece 1100, the second piece 1200, the third piece 1300, the partition wall 3000 and the fourth piece 1400 can be integrally formed by an injection manufacturing method, for example. The noise-reducing device 400 can have a plurality of hollow portions 1010 due to the first piece 1100, the second piece 1200, the third piece 1300, the partition wall 3000 and the fourth piece 1400.

In some examples, the number of through-holes 2000 can correspond to the number of hollow portions 1010. The plurality of hollow portions 1010 and the plurality of through-holes 2000 corresponding to the plurality of hollow portions 1010 each can serve as the noise-reducing device 400.

At least one of the plurality of divided hollow portions 1010 can have a different volume from the rest of the hollow portions 1010. Accordingly, the plurality of hollow portions 1010 can have different volumes.

In some implementations, the plurality of hollow portions 1010 provided in the noise-reducing device 400 can have different volumes, and thus the noise-reducing device 400 can have the plurality of various resonance frequencies. Accordingly, noise with various frequencies generated from the noise generating device can be effectively reduced.

In some implementations, each through-holes 2000 corresponding to each hollow portion 1010 can have a different cross-sectional area, and thus the noise-reducing device 400 can have various resonance frequencies. Since it has the plurality of various resonance frequencies, the noise-reducing device 400 can effectively reduce noise with various frequencies generated in the noise generating device.

FIG. 19 is a view showing an example structure in which a plurality of noise-reducing devices 400 are coupled. FIG. 20 is a view showing another example structure in which a plurality of noise-reducing devices 40 are coupled.

As shown in FIGS. 19 and 20, the plurality of noise-reducing devices 400 can be provided, and the communication hole 410 can be provided in a number corresponding to the number of noise-reducing devices 400. In some examples, the plurality of noise-reducing devices 400 can be coupled to each other and the second piece 1200 can partition the plurality of noise-reducing devices 400.

In some implementations, the plurality of noise-reducing devices 400 can be used, and the volumes of the plurality of hollow portions 1010 provided in each noise-reducing device 400 can be formed differently from each other. Due to this structure, each hollow portion 1010 and each through-hole 2000 can have various resonance frequencies in the structure in which the plurality of noise-reducing devices 400 are combined.

Therefore, the structure having the plurality of noise-reducing devices 400 combined to each other can reduce the noise with various frequencies generated in the noise generating device, thereby effectively reducing noise with a board frequency band.

The implementations are described above with reference to a number of illustrative implementations thereof. However, the present disclosure is not intended to limit the implementations and drawings set forth herein, and numerous other modifications and implementations can be devised by one skilled in the art. Further, the effects and predictable effects based on the configurations in the disclosure are to be included within the range of the disclosure though not explicitly described in the descriptions.

What is claimed is:

1. A refrigerator comprising:

a mechanism chamber having a lateral wall that defines a ventilation hole configured to discharge air from the mechanism chamber to an outside of the mechanism chamber; and a noise-reducing device that is disposed adjacent to the ventilation hole and defines a communication hole in communication with the ventilation hole, the noise-reducing device having a hollow shape with a predetermined inner space, wherein the noise-reducing device comprises a frame that defines a plurality of hollow portions that are arranged around the ventilation hole, wherein the frame comprises:

a first piece that is disposed inside the noise-reducing device and defines the communication hole, and a second piece that defines an outside of the noise-reducing device, wherein the noise-reducing device is one of a plurality of noise-reducing devices that are coupled to one another, and the second piece partitions the plurality of noise-reducing devices, and wherein a volume of at least one of the plurality of hollow portions is different from a volume of another of the plurality of hollow portions.

2. The refrigerator of claim 1, wherein the frame defines a through-hole that communicates air between the plurality of hollow portions and the outside.

3. The refrigerator of claim 2, wherein the through-hole is one of a plurality of through-holes, and wherein the plurality of through-holes are arranged to surround the communication hole, each of the plurality of through-holes having a predetermined depth.

4. The refrigerator of claim 2, wherein the plurality of noise-reducing devices are attached to the lateral wall of the mechanism chamber.

5. The refrigerator of claim 4, wherein the through hole faces an inside of the mechanism chamber.

6. The refrigerator of claim 5, wherein the frame further comprises:

a third piece that couples the first piece to the second piece, the third piece defining the through-hole.

7. The refrigerator of claim 6, further comprising:

a partition wall that is coupled to the first piece, the second piece, and the third piece of the frame to thereby partition the frame into the plurality of hollow portions.

8. The refrigerator of claim 6, wherein each of the plurality of noise-reducing devices defines one communication hole in communication with the ventilation hole.

9. A noise-reducing device configured to be disposed at a first lateral surface of a mechanism chamber of a refrigerator, wherein the first lateral surface defines a first hole, the noise-reducing device comprising:

a plurality of covers that define a resonance chamber and are configured to be disposed at a position corresponding to the first hole defined at the first lateral surface of the mechanism chamber, the plurality of covers having a shape corresponding to the first hole; and an acoustic filter that passes through the resonance chamber and has a hollow tube shape, wherein the noise-reducing device defines one or more holes that are in communication with the first hole defined at the first lateral surface of the mechanism chamber, wherein the plurality of covers comprise:

a first cover that is configured to be in contact with the first lateral surface of the mechanism chamber, the first cover defining a second hole in communication with the first hole; and a second cover that faces the first cover and defines a third hole, and wherein a size of the second hole is less than a size of the third hole.

10. The noise-reducing device of claim 9, wherein the acoustic filter connects between the second hole and the third hole, and wherein the first hole, the second hole, and the third hole are in communication with one another through the acoustic filter.

11. The noise-reducing device of claim 10, wherein shapes of the first and second holes are identical, wherein the acoustic filter has (i) a first end having a first shape corresponding to the first hole and the second hole and (ii) a second end having a second shape corresponding to the third hole, wherein the acoustic filter is configured to discharge heat generated by a machine component disposed inside the mechanism chamber to an outside of the mechanism chamber through the first hole, the second hole, and the third hole, and wherein the resonance chamber is configured to diffract and resonate noise that is generated by the machine component and transmitted into the resonance chamber through the acoustic filter.

12. The noise-reducing device of claim 11, wherein the first hole, the second hole, and the third hole have a circular shape.

13. The noise-reducing device of claim 12, wherein the acoustic filter has a conical shape.

14. The noise-reducing device of claim 11, wherein the first hole is one of a plurality of first holes defined at the first later surface of the mechanism chamber, wherein the second hole is one of a plurality of second holes defines at the first cover, wherein the third hole is one of a plurality of third holes defined at the second cover, wherein the acoustic filter is one of a plurality of acoustic filters, each of the plurality of acoustic filters connecting between one of the plurality of second holes and a corresponding one of the plurality of third holes, and wherein the plurality of first holes, the plurality of second holes, and the plurality of third holes are arranged in a matrix shape.

15. The noise-reducing device of claim 11, wherein the second cover has a concave shape that is recessed toward the third hole.

16. The noise-reducing device of claim 9, wherein the acoustic filter is made of non-woven fabric.

17. The noise-reducing device of claim 10, wherein the refrigerator includes a storage compartment, and a lower area of a rear surface of the storage compartment is inclined, wherein the mechanism chamber is defined in the lower area of the rear surface of the storage compartment, and wherein the plurality of covers further comprise a third cover that faces the lower area of the rear surface of the storage compartment, the third cover being inclined to thereby avoid interference with the lower area of the rear surface of the storage compartment.

18. A noise-reducing device configured to be disposed at a first lateral surface of a mechanism chamber of a refrigerator, wherein the first lateral surface defines a first hole, the noise-reducing device comprising:

a plurality of covers that define a resonance chamber and are configured to be disposed at a position corresponding to the first hole defined at the first lateral surface of the mechanism chamber, the plurality of covers having a shape corresponding to the first hole; and an acoustic filter that passes through the resonance chamber and has a hollow tube shape, wherein the acoustic filter is made of non-woven fabric, and wherein the noise-reducing device defines one or more holes that are in communication with the first hole defined at the first lateral surface of the mechanism chamber.

* * * * *